United States Patent [19]

Baker

[11] Patent Number: 4,834,302

[45] Date of Patent: May 30, 1989

[54] APPARATUS FOR CHIPPING AND/OR SHREDDING BRANCHES AND THE LIKE

[76] Inventor: Herbert R. Baker, 2334 S. 63rd St., West Allis, Wis. 53219

[21] Appl. No.: 124,039

[22] Filed: Nov. 23, 1987

[51] Int. Cl.[4] ..... B02C 13/28

[52] U.S. Cl. ..... 241/92; 241/101.7; 241/194; 241/195

[58] Field of Search ..... 241/92, 101.7, 101 A, 241/73, 194, 195, 189 R, 295, 152 R

[56] References Cited

U.S. PATENT DOCUMENTS

| | | | |
|---|---|---|---|
| 1,301,316 | 4/1919 | Plaisted | 241/195 X |
| 1,560,865 | 11/1925 | Sedberry . | |
| 1,687,093 | 10/1928 | Holm . | |
| 1,753,970 | 4/1930 | Rolfsen . | |
| 2,141,663 | 12/1938 | Ossing | 241/295 |
| 2,607,538 | 8/1952 | Larson | 241/195 |
| 3,084,942 | 4/1963 | Kucera . | |
| 3,861,603 | 1/1975 | Lautzenheiser . | |
| 3,907,214 | 9/1975 | Dankel . | |

*Primary Examiner*—Mark Rosenbaum
*Attorney, Agent, or Firm*—Andrus, Sceales, Starke & Sawall

[57] ABSTRACT

An apparatus for shredding branches, limbs, twigs, leaves or like material includes a housing having a lower cavity. A rotatable shredding mechanism is provided in the lower cavity. The shredding mechanism includes a plurality of substantially triangular shaped hammers for shredding material within the cavity. The triangular shape of the hammers increases the energy available for shredding material contained within the cavity. The shredding mechanism includes a drive shaft to which a drive sheave is connected, and is driven by a motor having a rotatable motor shaft to which a motor sheave is connected. A belt is provided about the motor and drive sheaves. A clutch mechanism for selectively imparting rotation to said drive shaft from said motor shaft includes an axially movable clutch bar to which a clutch sheave is rotatably connected. The clutch bar is movable between an engaged position in which the clutch sheave tensions the belt about the motor sheave and the drive sheave so as to cause rotation of the drive sheave in response to rotation of the motor sheave, and a disengaged position in which slack is introduced into the belt so that rotation of the motor sheave is not transferred to the drive sheave. A spring is provided to bias the clutch bar toward its engaged position. A pair of pins cause slack introduced into the belt when the clutch sheave is in its disegaged position to be directed about the motor sheave to ensure that rotary power is not transferred.

9 Claims, 6 Drawing Sheets

FIG. 1
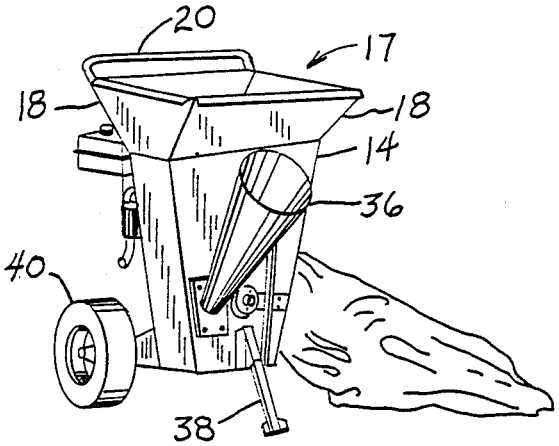
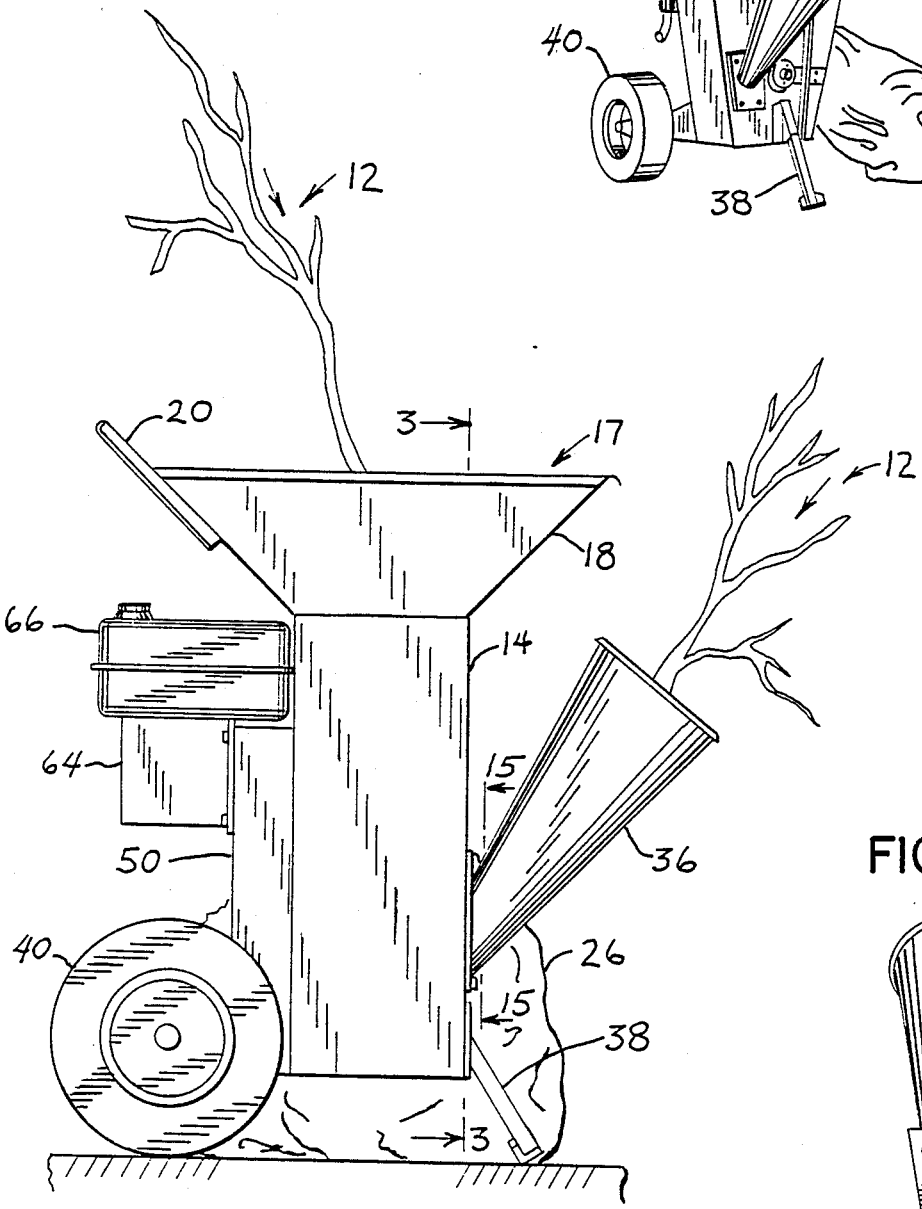
FIG. 2
FIG. 3
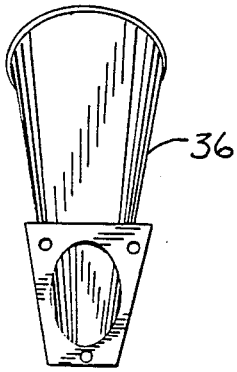

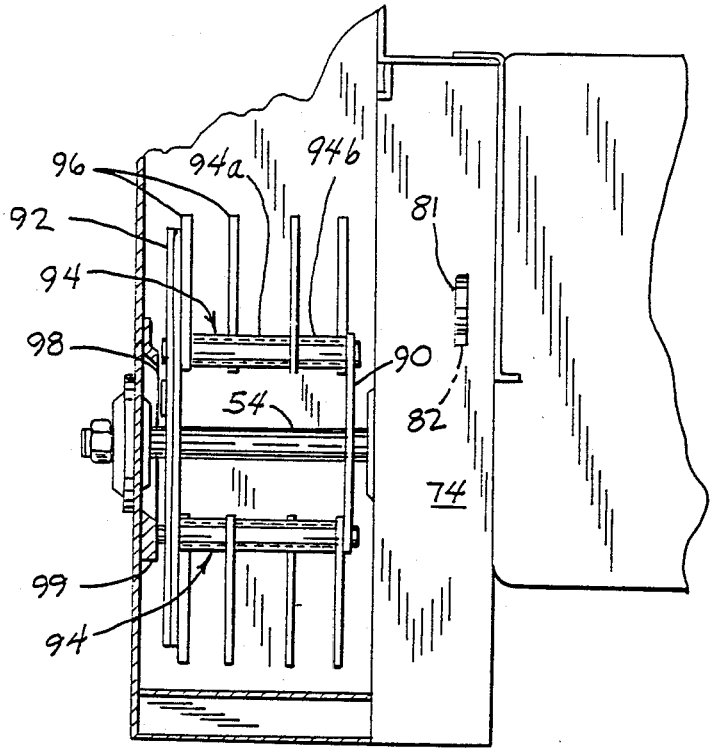
FIG. 12
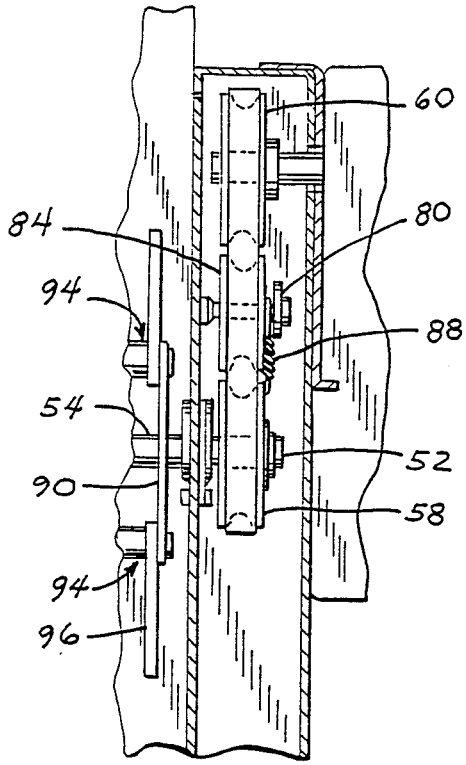
FIG. 13
FIG. 14
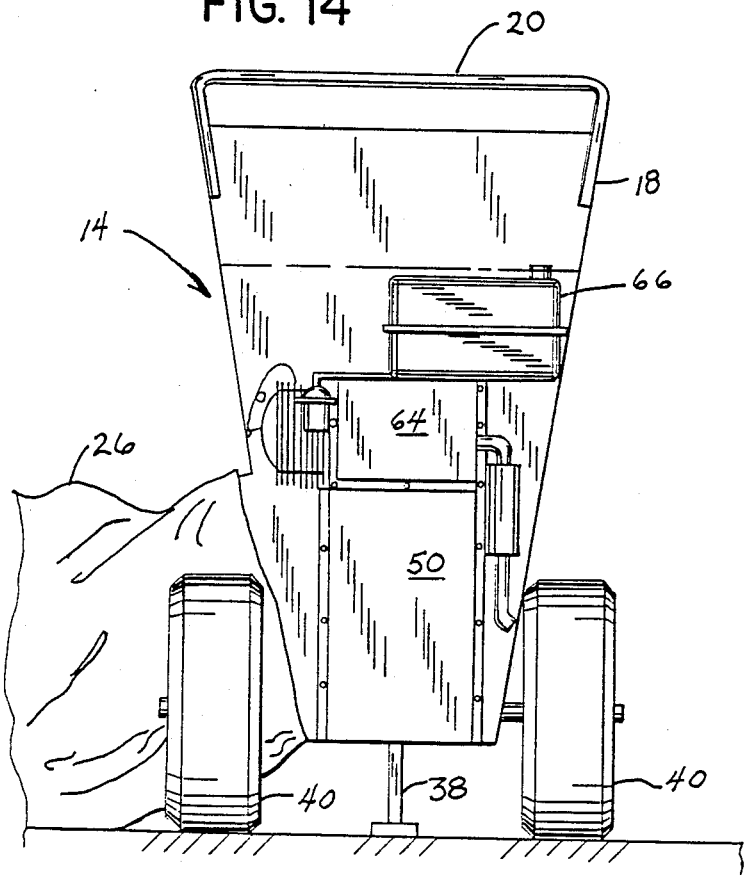

APPARATUS FOR CHIPPING AND/OR SHREDDING BRANCHES AND THE LIKE

FIELD OF THE DISCLOSURE

This invention relates to an apparatus for chipping and/or shredding branches, limbs, twigs, leaves and the like. More specifically, the invention provides a machine capable of chipping and/or shredding such material into mulch to facilitate packing.

DESCRIPTION OF THE PRIOR ART

The following U.S. Patents were noted in the course of a novelty search: U.S. Pat. No. 1,560,865 to Sedberry; U.S. Pat. No. 1,687,093 to Holm; U.S. Pat. No. 1,753,970 to Rolfsen; U.S. Pat. No. 3,084,942 to Kucera; U.S. Pat. No. 3,861,603 to Lautzenheiser et al; and U.S. Pat. No. 3,907,214 to Dankel.

SUMMARY OF THE INVENTION

This invention provides an apparatus for chipping and/or shredding branches, limbs, twigs, leaves and like material, comprising a generally hollow housing means having a passage leading to a lower shredding cavity and a hopper means for receiving and feeding such material into the passage. A rotatable shredding means is provided in the lower cavity. A lower entrance aperture is formed in the housing means adjacent the lower cavity, and an exit opening is formed in the housing means leading from the lower cavity. A chipper block is provided in the interior of the housing means adjacent the lower entrance aperture, against which larger branches or limbs inserted therethrough are chipped by one or more rotatable chipper knives disposed on the shredding means.

The shredding means includes a rotatable drive shaft mounted to the housing means. A plurality of triangular hammers are mounted to the rotatable drive shaft by means of one or more pivot bars and are rotatable 360° thereabout. In one embodiment, the pivot bars extend generally parallel to the drive shaft. The hammers are mounted on the pivot bars so as to be capable of freely swinging thereabout. Each hammer is mounted to its pivot bar adjacent one of its vertices, and the triangular shape of the hammers provides an increased mass swinging about the pivot bars to increase the kinetic energy available for the shredding operation. The chipper knives are also mounted to the rotatable drive shaft and are disposed adjacent the chipper block.

An improved clutch mechanism is provided for selectively transferring power from a motor having a rotatable motor sheave to the drive shaft, which is connected at one of its ends to a drive sheave. A belt is provided around the motor and drive sheaves. The clutch mechanism includes a clutch sheave rotatably connected to an axially movable clutch bar. The clutch bar is movable between an engaged position in which the clutch sheave tensions the belt about the motor and drive sheaves and a disengaged position in which slack is introduced into the belt around the motor and drive sheaves. A bias means is provided to bias the clutch bar toward its engaged position. In one embodiment, a pulley housing is connected to the exterior of the housing means. The pulley housing includes a pair of spaced supports, with each support having a clutch bar aperture therein through which the clutch bar extends. Sliding the clutch bar in one direction through the clutch bar apertures causes the clutch sheave to tension the belt about the drive and motor sheaves to impart rotation to the drive sheave in response to rotation of the motor sheave. Sliding the clutch bar in the other direction slackens the belt and releases such tension to stop rotation of the drive sheave. The bias means comprises a spring connected between one of the supports and the clutch bar. A pair of pins are provided for urging slack in the belt when the clutch bar is in its disengaged position toward the motor sheave.

BRIEF DESCRIPTION OF THE DRAWINGS

The drawings illustrate the best mode presently contemplated of carrying out the invention.

In the drawings:

FIG. 1 is a perspective view of the chipping and shredding apparatus of the invention;

FIG. 2 is an enlarged side elevation view of the apparatus of FIG. 1;

FIG. 3 is an elevation view of an auxiliary hopper for mounting to the housing adjacent the lower entrance aperture for receiving larger braches or limbs;

FIG. 12 is an enlarged partial sectional view showing the lower components of the apparatus shown in FIG. 5;

FIG. 13 is an enlarged partial sectional view taken generally along line 13—13 of FIG. 10;

FIG. 14 is a rear elevation view of the chipping and shredding apparatus of FIG. 1;

DETAILED DESCRIPTION OF THE PREFERRED EMBODIMENT

Figure 4:
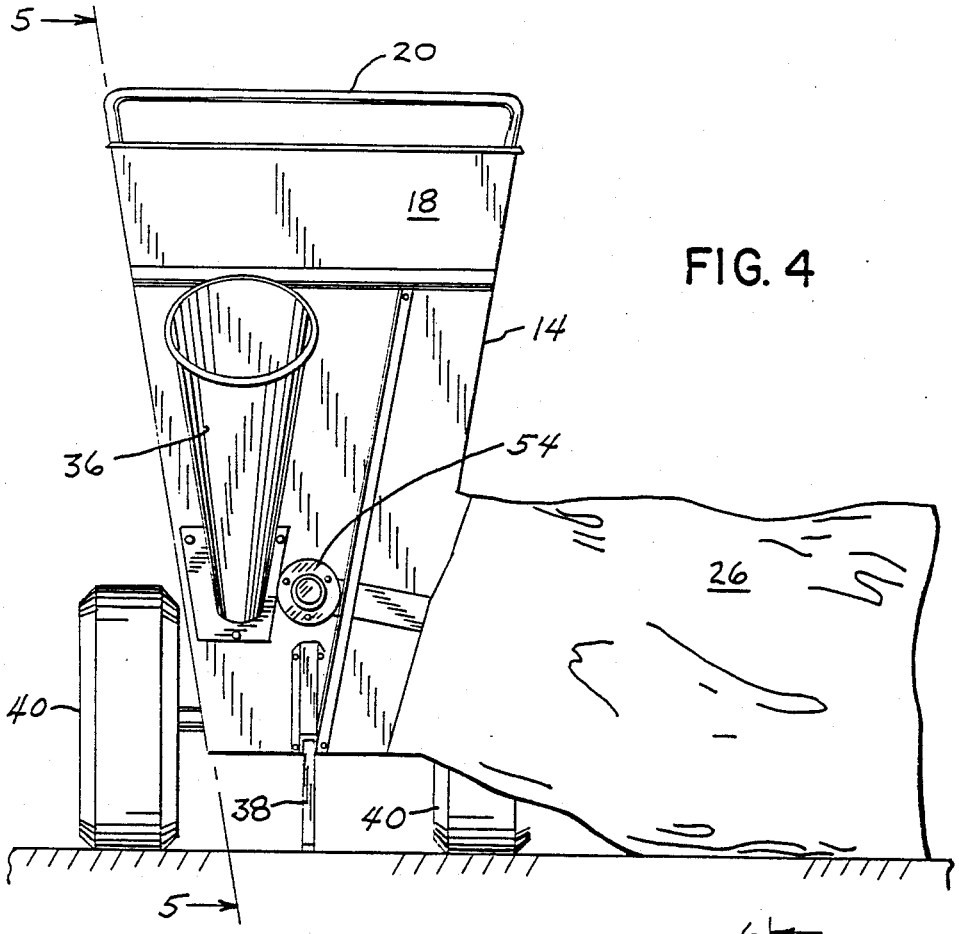
FIG. 4 is an enlarged end elevation view of the apparatus of FIG. 1.

With reference to the drawings, there is seen an apparatus 10 for cutting, chipping and/or shredding of branches, limbs, twigs, leaves and like material, generally identified as 12. The apparatus 10 includes a generally hollow housing 14 having a lower cavity 15 provided in the lower portion thereof. A passage 16 in housing 14 leads to lower cavity 15. A hopper 17 having diverging side portions 18 is connected to the upper end of housing 14 over passage 16. A handle 20 is attached to one of the diverging sides 18 of hopper 17 at the rear of apparatus 10 (FIG. 2).

Three flexible closure members 21 (FIGS. 5 and 6) are attached to the periphery of passage 16 to close off passage 16 when material 12 is not being inserted into the interior of housing 14. The insertion of material 12 such as branches, limbs, leaves and the like downwardly into housing 14 through passage 16 and into lower cavity 15 causes closure members 21 to flex downwardly in the direction of the arrows of FIG. 5 to form an upper entrance aperture 22, wherethrough material 12 passes into lower cavity 15.

Figure 6:
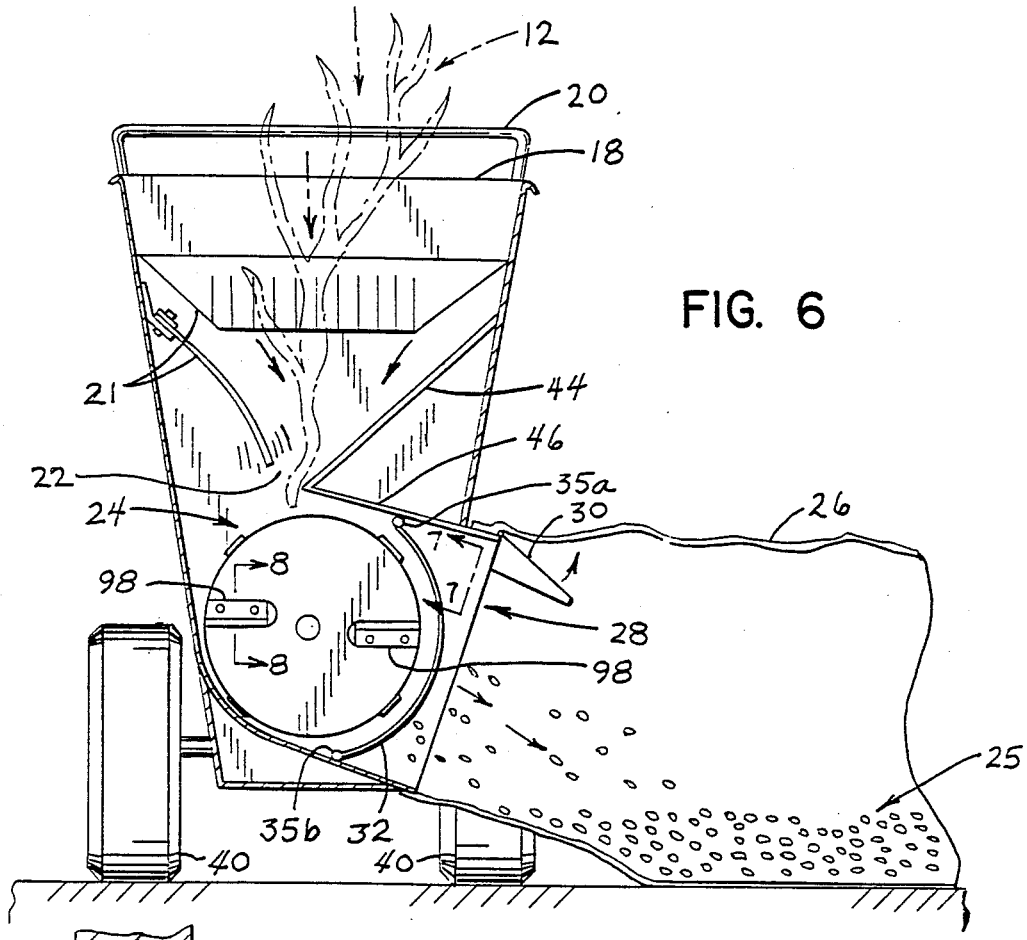
FIG. 6 is a sectional view taken generally along line 6—6 of FIG. 5.

A shredding means, generally illustrated at 24, is rotatably disposed in lower cavity 15. The construction and operation of shredding means 24 will be explained in detail hereafter. Shredding means 24 functions to shred the material 12 present within lower cavity 15 into a mulch 25 (FIG. 6). Mulch 25 is directed into a bag 26 or onto the ground after passing through an exit opening 28 formed in the lower portion of housing 14 adjacent shredding means 24. A deflector hood 30 is pivotably mounted to housing 14 adjacent the upper edge of exit opening 28 to assist in directing the mulch 25 from exit opening 28.

Figure 7:
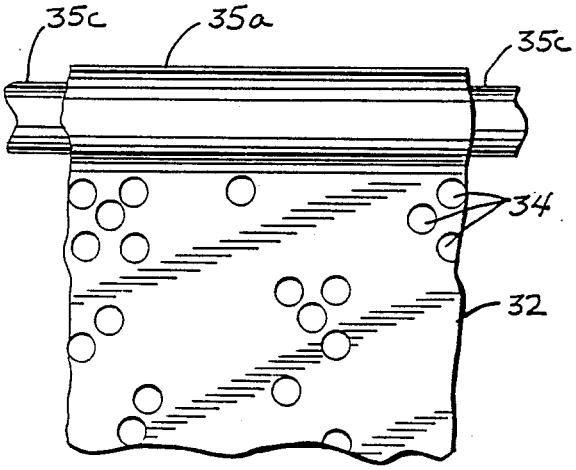
FIG. 7 is a partial elevation view of a perforated screen for mounting adjacent the lower cavity, taken generally along line 7—7 of FIG. 6.

A perforated screen 32 (FIGS. 6, 7) is positioned between the shredding means 24 and exit opening 28. Screen 32 defines a portion of the periphery of lower cavity 15 in which shredding means 24 is disposed. Screen 32 has a plurality of apertures 34 wherethrough the mulch 25 is directed. Apertures 34 are sized according to the desired final particle size of the mulch 25. Screen 32 acts to retain material within lower cavity 15 to ensure that such material is chopped or shredded to the appropriate size by shredding means 24 such that it will pass through apertures 34.

Screen 32 is connected at its upper and lower ends to upper and lower tubular members 35*a*, 35*b*, respectively. A removable upper pin 35*c* (FIG. 7) passes through upper tubular member 35*a* and through apertures formed in housing 14 (not shown) adjacent the ends of upper tubular member 35*a*. Likewise, a removable lower pin (not shown) passes through lower tubular member 35*b* and through apertures formed in housing 14 (not shown) adjacent the ends of lower tubular member 35*b*. In this manner, screen 32 is removably retained in the interior of housing 14 between shredding means 24 and exit opening 28. If desired, screen 32 can be removed and replaced by a different screen having larger or smaller apertures according to the desired final size of the mulch 25.

Figure 15:
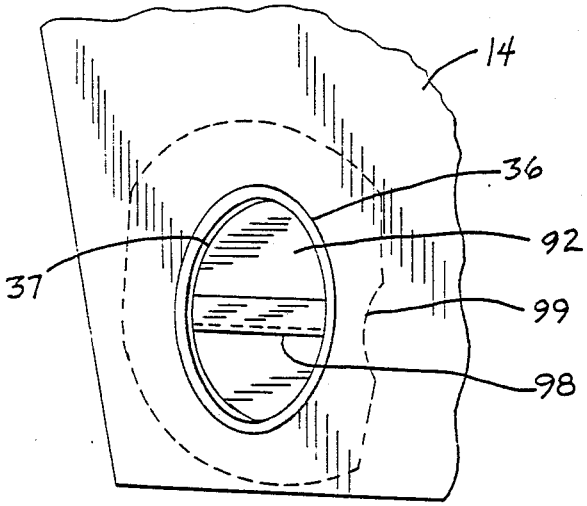
FIG. 15 is a partial sectional view taken generally along 15—15 of FIG. 2.

A conical auxiliary hopper 36 (FIG. 2) is connected to the side of housing 14 adjacent a lower entrance aperture 37 (FIG. 15) which leads to lower cavity 15. Auxiliary hopper 36 is intended to receive larger branches or limbs. A chipper block 99 having a central opening is provided on the interior of housing 14 adjacent lower entrance aperture 37. The chipper block opening registers with lower entrance aperture 37 such that branches or limbs passing therethrough are chipped against chipper block 99, as will be explained.

A leg 38 is connected to the lower front portion of housing 14, and a pair of wheels 40 are rotatably secured to the lower rear portion of housing 14. In combination, wheels 40 and leg 38 provide a stable support for apparatus 10 during operation. Wheels 40 also provide a means for transporting or pushing apparatus 10 from one location to another.

As shown in FIG. 6, an entrance baffle 44 is disposed in passage 16 adjacent upper entrance aperture 22. Entrance baffle 44 serves to direct material 12 into lower cavity 15 as the material is pushed downwardly into the interior of housing 14 through passage 16. An exit baffle 46 is connected to the lower end of entrance baffle 44 and serves to partially define lower cavity 15. Exit baffle 46 also directs chipped or shredded material outwardly toward exit opening 28.

Figure 10:
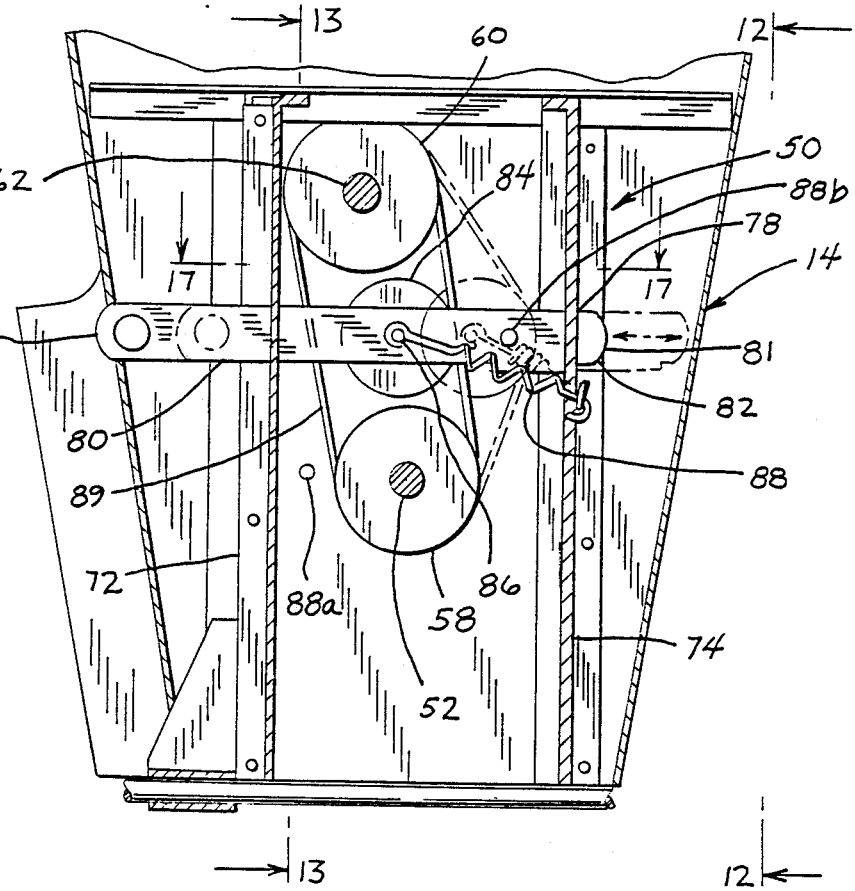
FIG. 10 is a sectional view taken generally along line 10—10 of FIG. 5 showing the clutch bar and the clutch, motor and drive sheaves as mounted in the pulley housing.

A pulley housing, generally shown at 50 (FIGS. 2 and 5), is secured to the rear exterior surface of housing 14. Pulley housing 50 houses an end 52 of a drive shaft 54 connected to shredding means 24 and rotatably mounted within lower cavity 15. As seen in FIG. 10, a drive sheave 58 is connected to end 52 of drive shaft 54, and is contained within pulley housing 50. A motor sheave 60 connected to a rotatable motor shaft 62 is positioned in pulley housing 50 above drive sheave 58. A drive belt 89 is provided about motor sheave 60 and drive sheave 58, as is well known.

Motor shaft 62 is rotated by a motor 64 (FIG. 2) secured to the rear exterior surface of housing 14. Motor 64 may be any satisfactory source of power, such as an electric or gasoline powered engine. As shown, motor 64 is an internal combustion engine of conventional construction receiving fuel from a fuel tank 66 mounted thereabove.

The side walls of pulley housing 50 are generally defined by a pair of spaced opposed members 72, 74 (FIG. 10). Left support member 72 is provided with a slot 76, and right support member 74 is provided with a slot 78. A clutch bar 80 is slidably disposed within slots 76, 78 and is axially movable therein. The rightward end of clutch bar 80 is provided with a notch 82, the function of which will be explained.

A clutch sheave 84 is rotatably connected to a shaft 86 mounted on clutch bar 80. A spring 88 is connected at one end to shaft 86 and at the other end to right support member 74.

Figure 17:
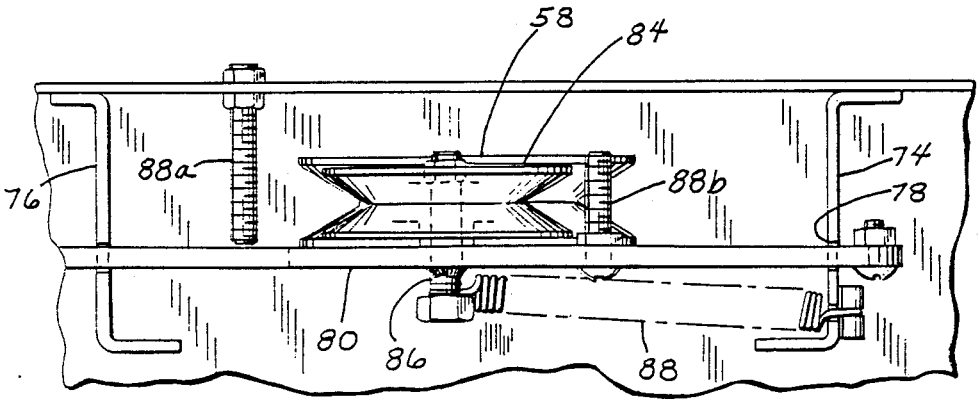
FIG. 17 is a partial sectional view taken generally along line 17—17 of FIG. 10.

As shown in FIGS. 10 and 17, a pair of guide pins 88*a*, 88*b* are provided in the interior of pulley housing 50. Guide pin 88*a* is connected to housing 14 and extends outwardly therefrom into the interior of pulley housing 50, and is located adjacent the leftwardmost point of drive sheave 58. Guide pin 88*b* is connected to clutch bar 80 and extends inwardly toward housing 14 within pulley housing 50. Guide pin 88*b* is substantially in horizontal alignment with shaft 86 to which clutch sheave 84 is mounted.

Figure 16:
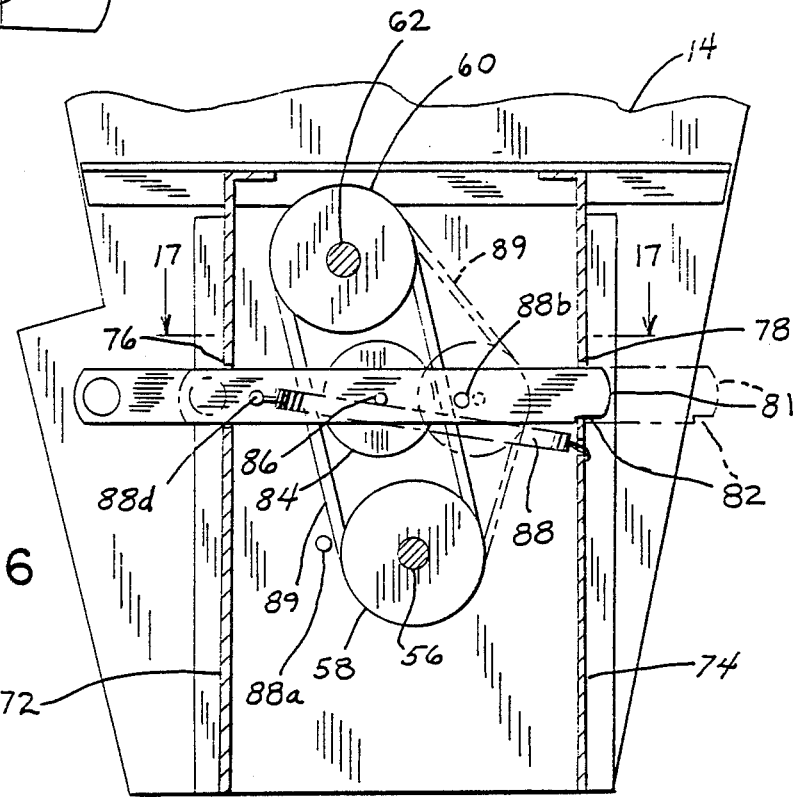
FIG. 16 is a view similar to FIG. 10 showing another embodiment of the clutch bar mechanism of the present invention.

An alternative construction of the clutch bar mechanism is shown in FIG. 16. In this embodiment, spring 88 extends between right support member 74 and a spring attachment point 88*d* disposed on clutch bar 80. In both embodiments of the clutch bar mechanism (FIGS. 10 and 16), spring 88 urges clutch bar 80 right-wardly toward an engaged position, shown by the phantom lines.

In operation, the clutch bar mechanism of the invention works as follows, with reference to both the embodiment of FIG. 10 and the embodiment of FIG. 16. When clutch bar 80 is in its rightwardmost, or engaged, position shown by the phantom lines in FIGS. 10 and 16, clutch sheave 84 provides tension in belt 89 about motor sheave 60 and drive sheave 58. In this manner, rotation of motor sheave 60 as by driven motor 64 causes rotation of drive sheave 58 and thus rotation of shredding means 24 in lower cavity 15. Clutch bar 80 is biased toward this engaged position by the force of spring 88 urging clutch bar 80 rightwardly.

When it is desired to achieve a neutral condition in which rotation of motor sheave 60 is not imparted to drive sheave 58, clutch bar 80 is moved to its leftwardmost, or disengaged, position as shown in the solid lines in FIGS. 10 and 16. Movement of clutch bar 80 toward this disengaged position causes clutch sheave 84 to release the tension of belt 89 about drive sheave 58 and motor sheave 60 so that slack is introduced into belt 89 about these sheaves.

Clutch bar 80 is retained in its disengaged position by engaging notch 82 at the rightward end of clutch bar 80 with the lower surface of slot 78 in right support member 74. Such engagement of notch 82 with slot 78 prevents the bias provided by spring 88 from moving clutch bar 80 toward its engaged position.

When clutch sheave 84 is moved leftwardly so that slack is introduced into belt 89, guide pins 88*a* and 88*b* serve to direct the slack in belt 89 upwardly so as too cause belt 89 to come out of engagement with motor sheave 60. That is, slack in belt 89 is first pushed leftwardly by guide pin 88*b* and then caused to move upwardly about motor sheave 60 by guide pin 88*a*. In this manner, rotation of drive sheave 58 by motor sheave 60 via belt 89 is prevented.

Clutch bar 80 is provided at its leftward end with a finger hole 83, which the operator uses to move clutch bar 80 between its engaged and disengaged positions. To move clutch bar 80 to its engaged position from its disengaged position, the operator inserts a finger through opening 83 and pushes downwardly so as to release notch 82 from the lower surface of slot 78 in right support member 74. The bias provided by spring 88 then causes clutch bar 80 to move rightwardly toward its engaged position. To move clutch bar 80 to its disengaged position, the operator inserts a finger through opening 83 and pulls clutch bar 80 leftwardly until notch 82 engages the lower surface of slot 78 so as to retain clutch bar 80 in such disengaged position.

Figure 5:
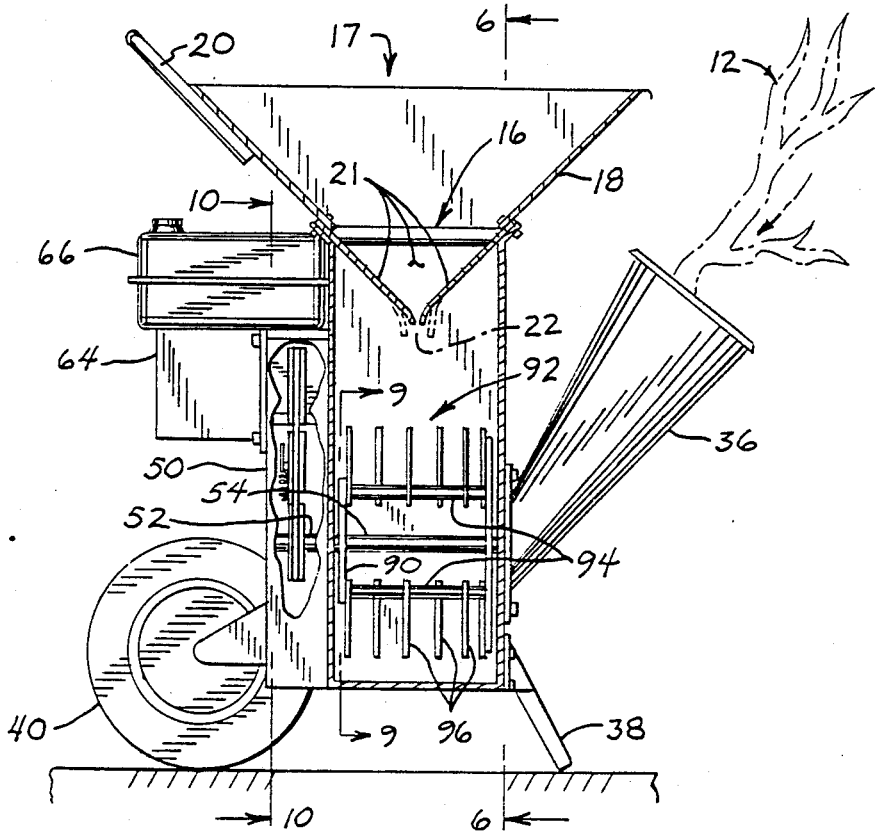
FIG. 5 is a sectional view taken generally along line 5—5 of FIG. 4.
Figure 9:
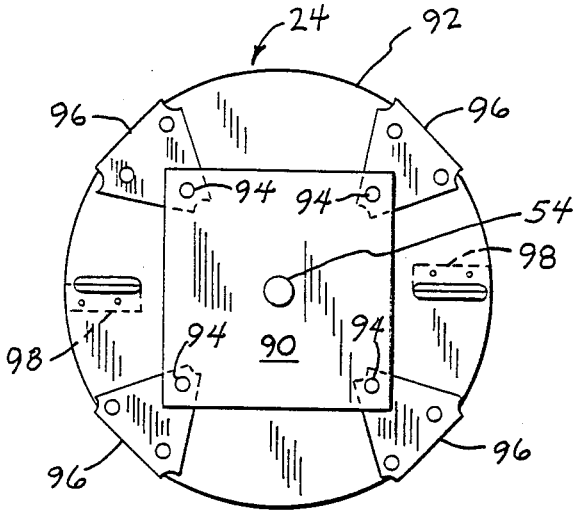
FIG. 9 is a side elevation view taken generally along line 9—9 of FIG. 5 showing the triangular rotating hammers of the present invention.

With reference to FIG. 5, the shredding means 24 includes a plate member 90 and a flywheel member 92 mounted to drive shaft 54. Plate member 90 is disposed within lower cavity 15 adjacent one side thereof, and flywheel member 92 is disposed adjacent the other side of lower cavity 15. A plurality of pivot bars 94 are provided between plate member 90 and flywheel member 94. With reference to FIG. 9, plate member 90 is square in shape and flywheel member 92 is circular. Pivot bars 94 are disposed adjacent each corner of plate member 90. It should be understood, however, that plate member 90 and flywheel member 92 can be any satisfactory shape, and are not limited to the shapes shown.

With reference to FIG. 12, each pivot bar 94 extends between and through plate member 90 and flywheel member 92. A pair of hammers 96 are mounted to each pivot bar 94, with spacing sleeves 94*a*, 94*b* to provide the appropriate positioning of hammers 96 along pivot bars 94. As can be seen, hammers 96 are arranged on pivot bars 94 so as to be in a staggered relationship with respect to each other. That is, the hammers on one pivot bar are staggered or offset with respect to the hammers mounted on adjacent pivot bars. A pin (not shown) is inserted transversely through an opening provided in one of sleeves 94*a* or 95*b* and its associated pivot bar 94, to mount the pivot bar and its associated hammers 96 to plate member 90 and flywheel member 92. Upon removal of the pin, the pivot bar 94 may be slid through the opening provided in either flywheel member 92 or plate member 90 so as to allow the operator to replace, repair or rotate hammers 96 as necessary. Pivot bars 94 are mounted to plate member 90 and flywheel 92 so as to be freely rotatable.

Figure 11:
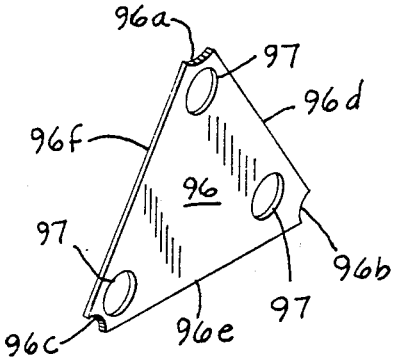
FIG. 11 is a perspective view of one of the rotatable hammers shown in FIG. 9.

With reference to FIG. 11, the hammers 96 are triangular in shape, with each corner or vertex of hammer 96 being provided with an aperture 97 therethrough. Apertures 97 are adapted to receive a pivot bar 94 therethrough for mounting hammer 96 thereto. Arcuate indentations 96*a*, 96*b* and 96*c* are provided at each vertex of triangular hammer 96 to provide a pair of hammering points. Flat surfaces 96*d*, 96*e* and 96*f* extend between the vertices of triangular hammer 96.

When mounted on pivot bars 94 as shown in FIG. 9, each hammer 96 is freely rotatable about its respective pivot bar 94. Additionally, the entire assembly is rotated by means of rotation of drive shaft 54. In this manner, hammers 96 are rotatable about their respective pivot bars as well as about drive shaft 54.

Apertures 97 in each hammer 96 provide a means of repositioning each hammer 96 about its respective pivot bar 94 to provide a new set of hammering points and a new hammering surface as necessary. For example, with reference to FIG. 11, when pivot bar 94 extends through the bottom left aperture 97 and hammer 96 is rotated thereabout and also about drive shaft 54, the hammering points adjacent either arcuate indentation 96*a* or 96*b*, depending on the direction of rotation, will perform the bulk of the shredding and grinding of material within lower cavity 15. Edge 96*f* or 96*e* will also do a certain amount of shredding and grinding of material within lower cavity 15. When the hammering points adjacent indentation 96*a* or 96*b* become dull, hammer 96 may be removed from its respective pivot bar 94 as above described, and pivot bar 94 inserted through a different aperture 97 to provide a new set of hammering points and a new hammering edge.

As previously noted, the triangular shape of hammers 96 provides an increased swinging mass about the mounting axis through which each hammer 96 is mounted to its respective pivot bar 94. That is, the triangular shape provides a significantly increased amount of mass spaced from the mounting axis as compared to previously used rectangular hammers. This increased mass swinging about the mounting axis increases the amount of kinetic energy supplied by each hammer when shredding means 24 is rotated. Such increased kinetic energy is available for grinding or shredding material within lower cavity 15. With proper design of triangular hammers 96, an increase of three times the amount of kinetic energy available from conventional hammer configurations is provided for shredding and grinding material. This increase in the amount of kinetic energy supplied by the hammers provides a more efficient and effective grinding and shredding operation.

Figure 8:
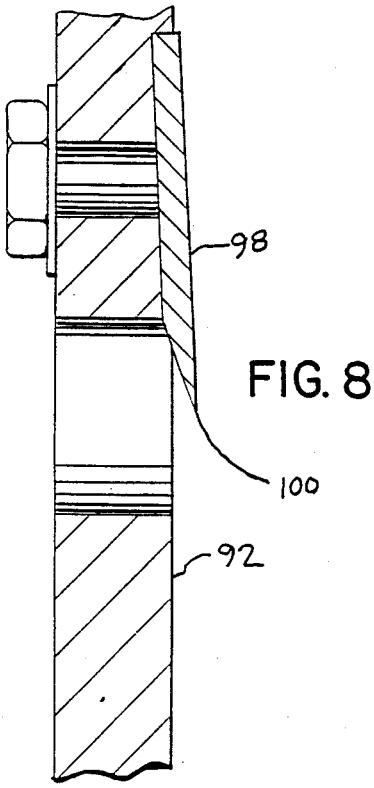
FIG. 8 is an enlarged partial sectional view taken generally along line 8—8 of FIG. 6.

With reference to FIGS. 6, 8 and 12, a pair of chipper knives 98 are provided on the outer face of flywheel member 92 and are radially oriented with respect thereto. It should be appreciated that any number of chipper knives may be employed. Chipper knives 98 have a chipping edge 100 for performing heavy duty chipping and cutting on branches or limbs fed into lower cavity 15 through lower entrance aperture 37. Chipper knives 98 pass in close proximity to chipper block 99 over the chipper block opening for performing the chipping operation.

In operation, the chipping and/or grinding operation is commenced by moving clutch bar 80, and its associated clutch sheave 84, into its engaged position as described above. This causes rotation of shredding means 24 about its drive shaft 54. Rotation of shredding means 24 causes hammers 96 to come into contact with material such as branches, limbs, twigs, leaves or the like fed into lower cavity 15. Material fed through upper entrance aperture 22 and passage 16 is subjected primarily to the action of hammers 96, and is repeatedly hammered and shredded by the action of the hammering points and edges on hammers 96 until the material is of sufficient size to pass through apertures 34 in screen 32. The shredded material then exits lower cavity 15 through exit opening 28. If a particular piece of material is of sufficient strength or size so that a single pass of a hammer 96 is not sufficient to break through such material, hammer 96 simply rotates about its respective pivot bar 94 after impact therewith and out of the way of the piece of material so that the shredding means 24 continues to rotate and does not bind. The piece of material is then subjected to the shredding force of another hammer 96, which action is repeated until the piece of material is sufficiently ground and shredded into the appropriate size for passage through screen 32.

As noted, the inner surface of screen 32, in combination with the lower interior portion of housing 14 and the portion of baffle 46 located interiorly of screen 32, defines the wall of lower cavity 15 against which the hammering points of hammers 96 grinds and shreds material contained within lower cavity 15.

Larger branches or limbs passed through lower entrance aperture 37 via hopper 36 are subjected to the action of chipper knives 98 in cooperation with chipper block 99 to chip or cut such branches or limbs. The chips are then passed into the grinding or shredding area of lower cavity 15, and are subjected to the action of hammers 96 until they are of a sufficient size to pass through screen 32.

Various alternatives and modifications are contemplated as being within the scope of the following claims particularly pointing out and distinctly claiming the subject matter regarded as the invention.

I claim:

1. In an apparatus for shredding branches, limbs, twigs, leaves or like material, said apparatus including a housing having a shredding cavity disposed therein, a passage through which said material enters said cavity, and a movable shredding mechanism within said shredding cavity for shredding said material, the improvement comprising one or more substantially triangular hammers provided on said shredding mechanism, each said hammer including mounting means for pivotably mounting said hammer to said shredding mechanism, said mounting means providing a pivot axis for said hammer located off-center and adjacent one of the vertices of said hammer, each said hammer being pivotable about its mounting axis during movement of said shredding means so that, during movement of said shredding means, substantially the entire leading edge of said hammer is available to shred material within said shredding cavity, and the increased distance provided by the substantially triangular shape of said hammer between the pivot axis of said hammer and the centroid of the pivoting mass of said hammer provides increased energy for shredding said material.

2. An apparatus for shredding branches, limbs, twigs, leaves or the like material, comprising:

a housing having a shredding cavity disposed therein;

a passage through which said material enters said shredding cavity; and movable shredding means disposed within said cavity for shredding material therein, said shredding means including a plurality of substantially triangular hammers, each said hammer including mounting means for pivotably mounting said hammer to said shredding means, said mounting means providing a pivot axis for said hammer located off-center and adjecent one of the vertices of said hammer, each said hammer being pivotable about its mounting axis during movement of said shredding means so that, during movement of said shredding means, substantially the entire leading edge of said hammer is available to shred material within said shredding cavity, and the increased distance provided by the substantially triangular shape of said hammer between the pivot axis of said hammer and the centroid of the pivoting mass of said hammer provides increased energy for shredding said material.

3. The apparatus according to claim 2, wherein the pivot axis of each said hammer is disposed substantially along a line extending from the center of said hammer toward the vertex of said hammer to which said pivot axis is adjacent.

4. The apparatus according to claim , 2 wherein said shredding means includes one or more shafts and said mounting means for pivotably mounting each said hammer to said shredding means comprises an aperture located adjacent a vertex of said hammer for receiving one of said shafts therethrough.

5. The apparatus according to claim 4, wherein each said hammer has a mounting aperture adjacent each of its vertices, and wherein said hammers are removable from said one or more shafts to allow the mounting of said hammers to said one or more shafts to be changed from one aperture to another.

6. The apparatus according to claim 5, wherein each said hammer is provided with an arcuate indentation at each of its vertices to form a pair of shredding points so that, when said shaft extending through one of said apertures in said hammer is removed and said shaft is placed through a different one of said apertures, a different pair of said shredding points is made available for shredding said material.

7. The apparatus according to claim 5, wherein said shredding means includes a plurality of said shafts extending generally parallel to one another, and wherein said shafts are connected to a plate rotatably driven by a drive shaft for imparting rotation to said plate and to cause said shafts to rotate about said drive shaft, and wherein each said shaft is provided with one or more of said pivotable triangular hammers mounted thereto.

8. The apparatus according to claim 7, wherein said plate is connected at one end to each said shaft, and the other end of each said shaft is connected to a flywheel, with said shafts extending between said plate and said flywheel, and further comprising rotatable chipper means adjacent an end of said shafts and adjacent an opening in said housing through which branches or the like are fed into said chipper means for chipping said branches or the like.

9. The apparatus according to claim 8, wherein said chipper means comprises one or more chipper knives mounted to said flywheel and rotatable therewith, and a chipper block disposed adjacent said opening in said housing, with said chipper knives passing in close proximity over the opening in said housing so that said chipper knives chip said branches or the like against said chipper block.

* * * * *